US009308723B2

(12) United States Patent
Yokoyama et al.

(10) Patent No.: US 9,308,723 B2
(45) Date of Patent: Apr. 12, 2016

(54) INK JET HEAD AND INK JET RECORDING APPARATUS

(71) Applicant: TOSHIBA TEC KABUSHIKI KAISHA, Shinagawa-ku, Tokyo (JP)

(72) Inventors: Shuhei Yokoyama, Mishima (JP); Ryutaro Kusunoki, Mishima (JP); Ryuichi Arai, Numazu (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/317,125

(22) Filed: Jun. 27, 2014

(65) Prior Publication Data

US 2015/0002587 A1 Jan. 1, 2015

(30) Foreign Application Priority Data

Jun. 28, 2013 (JP) ..... 2013-136681

(51) Int. Cl.

*B41J 2/045* (2006.01)
*B41J 2/14* (2006.01)
*B41J 2/01* (2006.01)

(52) U.S. Cl.

CPC ..... *B41J 2/14201* (2013.01); *B41J 2002/012* (2013.01); *B41J 2202/15* (2013.01)

(58) Field of Classification Search

CPC ..... B41J 2/14201; B41J 2002/012; B41J 2202/15
USPC ..... 347/68–72
See application file for complete search history.

(56) References Cited

U.S. PATENT DOCUMENTS

| | | | | |
|---|---|---|---|---|
| 6,328,433 | B1 * | 12/2001 | Moriya et al. | 347/68 |
| 8,608,296 | B2 | 12/2013 | Nakatani | |
| 8,801,147 | B2 | 8/2014 | Kusunoki et al. | |
| 8,807,712 | B2 | 8/2014 | Nakatani | |
| 2006/0290748 | A1 * | 12/2006 | Shimada | 347/68 |
| 2011/0037813 | A1 | 2/2011 | Nakatani | |
| 2012/0056947 | A1 * | 3/2012 | Tanuma et al. | 347/71 |
| 2012/0152894 | A1 * | 6/2012 | Reitmeier | 216/36 |
| 2013/0070030 | A1 * | 3/2013 | Kusunoki et al. | 347/70 |
| 2013/0222484 | A1 | 8/2013 | Yokoyama et al. | |
| 2013/0271530 | A1 | 10/2013 | Yokoyama et al. | |
| 2014/0071207 | A1 | 3/2014 | Nakatani | |
| 2014/0267498 | A1 | 9/2014 | Shuhei Yokoyama et al. | |
| 2014/0320569 | A1 | 10/2014 | Kusunoki et al. | |

FOREIGN PATENT DOCUMENTS

| | | |
|---|---|---|
| JP | 2011-056939 | 3/2011 |
| JP | 2013-075511 | 4/2013 |
| WO | 2013-002775 | 1/2013 |

OTHER PUBLICATIONS

Office Action of Notification of Reason(s) for Refusal for Japanese Patent Application No. 2013-136681 dated Jun. 2, 2015, 7 pages.

* cited by examiner

*Primary Examiner* — Henok Legesse
(74) *Attorney, Agent, or Firm* — Amin, Turocy & Watson LLP; Gregory Turocy

(57) ABSTRACT

According to one embodiment, there is provided an ink jet head which includes a pressure chamber which is formed in a thickness direction of a substrate, and fills ink; a vibrating plate which is provided on a first face of the pressure chamber, and includes a nozzle which communicates with the pressure chamber; a driving unit which is provided on the vibrating plate, and includes a piezoelectric substance; and a warpage reducing layer which is provided on a second face which is opposite to the first face of the pressure chamber, and reduces warpage of the substrate.

7 Claims, 7 Drawing Sheets

INK JET HEAD AND INK JET RECORDING APPARATUS

CROSS-REFERENCE TO RELATED APPLICATION

This application is based upon and claims the benefit of priority from Japanese Patent Application No. 2013-136681, filed Jun. 28, 2013, the entire contents of which are incorporated herein by reference.

FIELD

Embodiments described herein relate generally to an ink jet head which ejects ink from a nozzle, and an ink jet recording apparatus.

BACKGROUND

There is an ink jet head which includes a nozzle ejecting ink, a piezoelectric element, and an actuator on a vibrating plate. It is necessary for the ink jet head to uniformly maintain precision in a landing position of ink which is ejected from a nozzle over the entire length. For this reason, it is necessary to uniformly maintain the precision in the landing position of ink which is ejected from the nozzle by setting an ejecting angle of ink which is ejected from the nozzle to be the same over the entire length of the ink jet head.

JP-A-2013-59915 is an example of the related art.

DETAILED DESCRIPTION

An object of an exemplary embodiment is to provide an ink jet head, and an ink jet recording apparatus in which an ejecting angle of ink from a nozzle is set to be the same over the entire length of the ink jet head, precision in the landing position of ink which is ejected from the nozzle is uniformly maintained, and printing with high precision is performed.

In order to realize the above described functions, an inkjet head in embodiments includes a pressure chamber which is formed in a thickness direction of a substrate, and fills ink; a vibrating plate which is provided on a first face of the pressure chamber, and includes a nozzle which communicates with the pressure chamber; a driving unit which is provided on the vibrating plate, and includes a piezoelectric substance; and a warpage reducing layer which is provided on a second face of the pressure chamber which is opposite to the first face, and reduces warpage of the substrate.

Hereinafter, embodiments will be described.

First Embodiment

Figure 1:
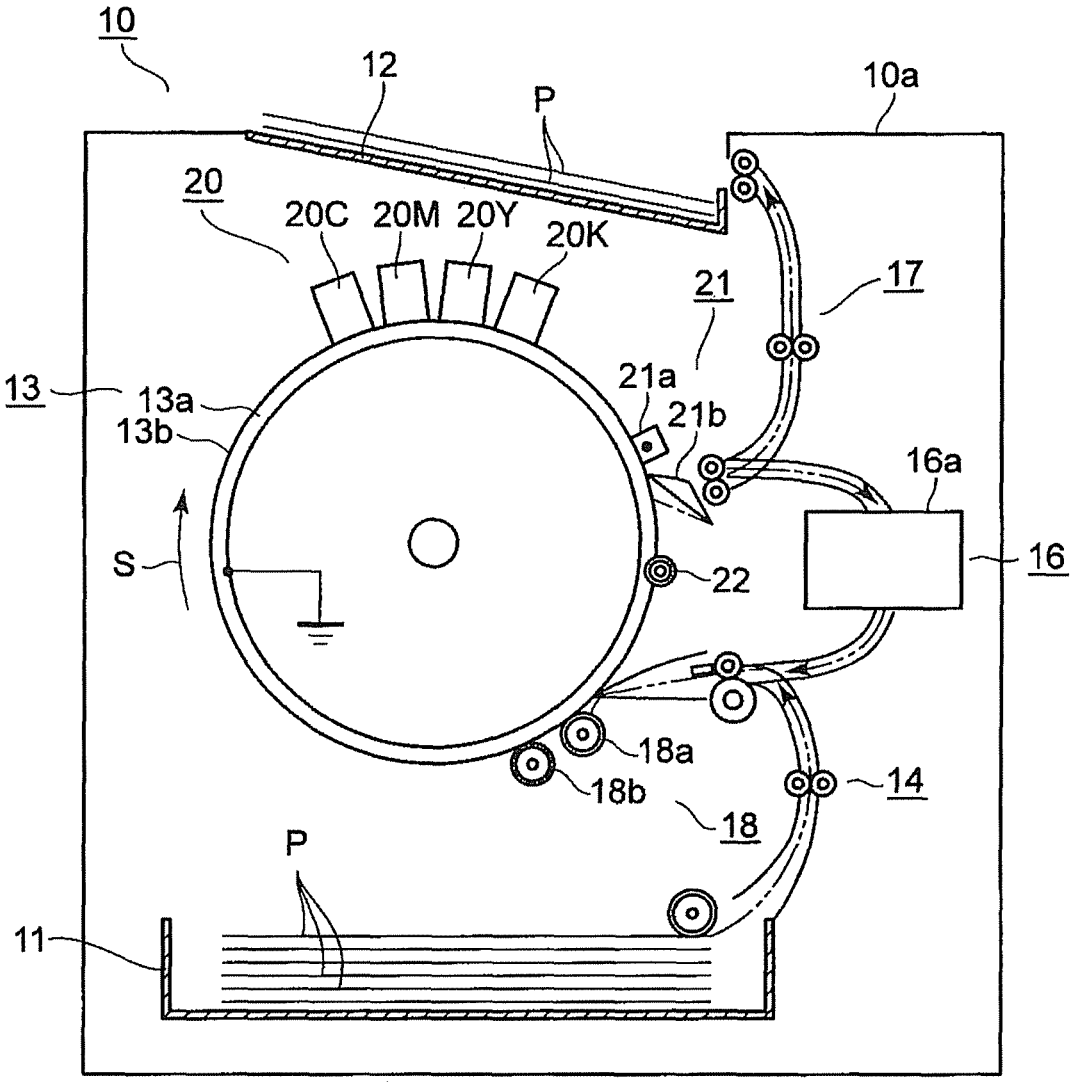
FIG. 1 is a schematic configuration diagram which illustrates an ink jet printer according to a first embodiment.
Figure 2:
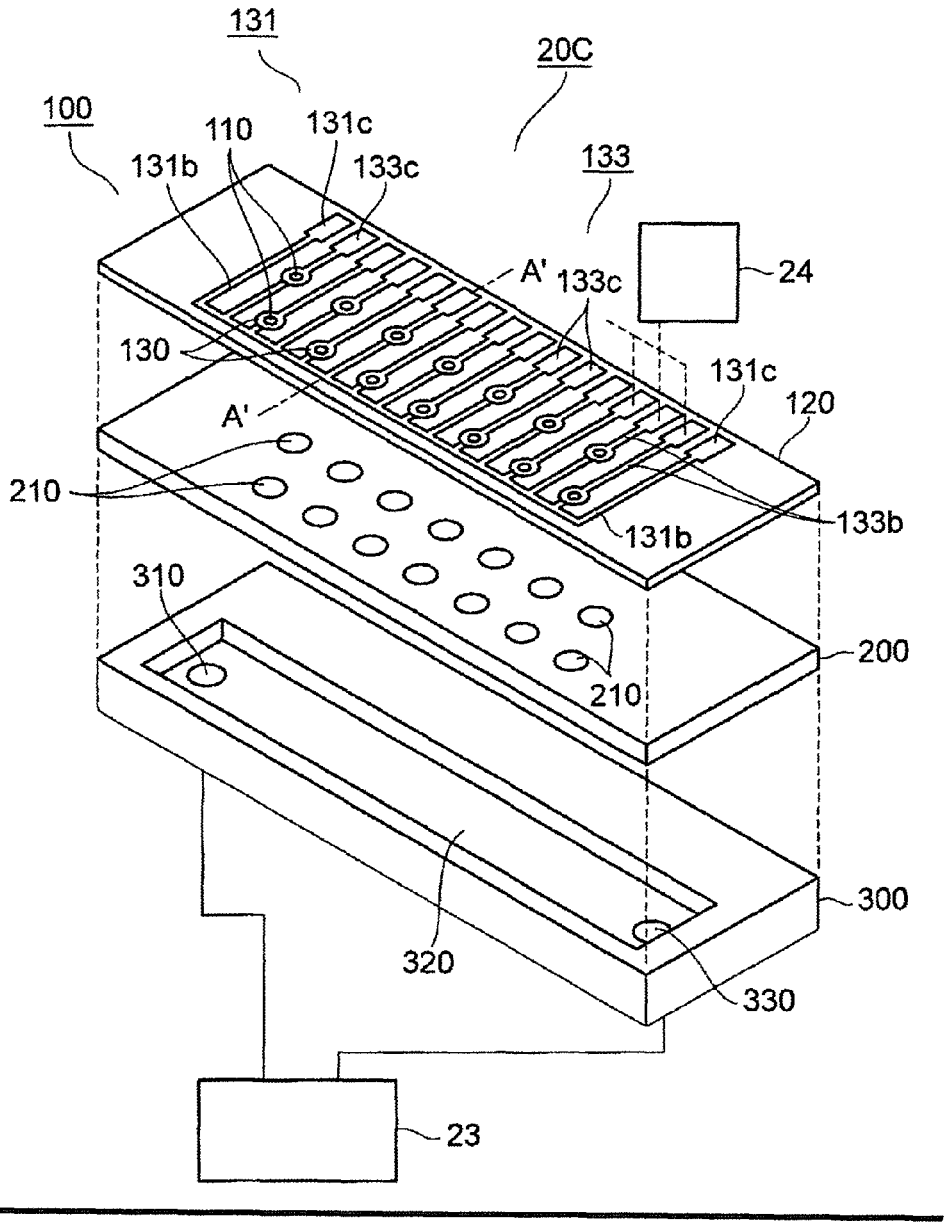
FIG. 2 is a schematic perspective view of an ink jet head which is dispersed according to the first embodiment.
Figure 3:
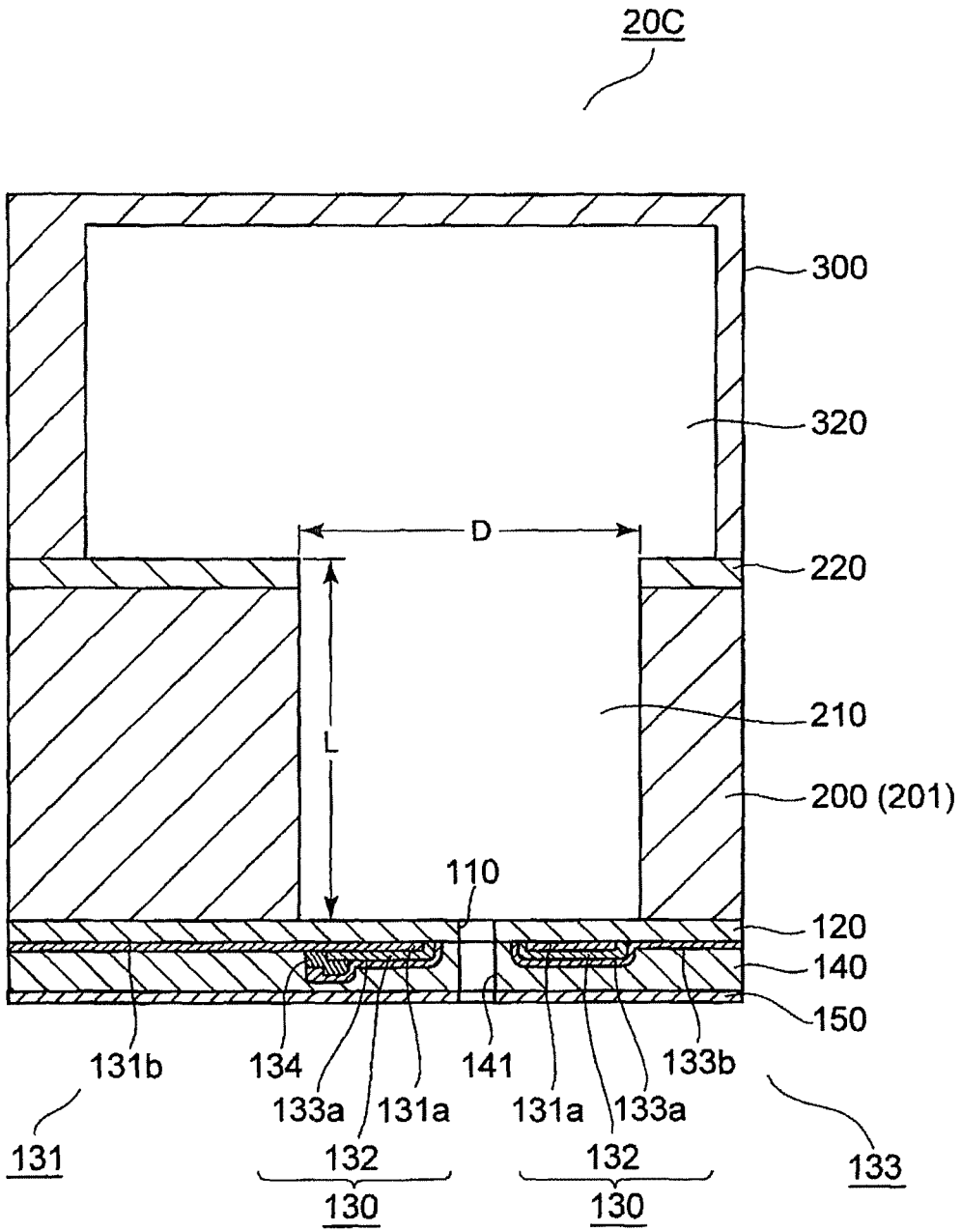
FIG. 3 is a schematic cross-sectional view of an ink jet head which is taken along line A-A' in FIG. 2.

An ink jet recording apparatus according to a first embodiment will be described with reference to FIGS. 1 to 3. FIG. 1 illustrates an example of an ink jet printer 10 which is an ink jet recording apparatus. The ink jet printer 10 illustrated in FIG. 1 performs various processes such as image forming while transporting a recording sheet P which is a recording medium. The ink jet printer 10 includes a housing 10*a* which configures an appearance, a sheet feeding cassette 11, a sheet discharging tray 12, a maintaining roller 13, a transport unit for sheet feeding 14 which is a transport unit, a reversing unit 16, and a transport unit for sheet discharging 17. The ink jet printer 10 includes a maintaining unit 18, an image forming unit 20, a separation unit 21, and a cleaning unit 22 at the periphery of the maintaining roller 13.

The sheet feeding cassette 11 accommodates the recording sheet P before being printed. The sheet discharging tray 12 accommodates the recording sheet P which is discharged from the housing 10*a* after forming an image thereon. The transport unit for sheet feeding 14 feeds the recording sheet P which is taken out from the sheet feeding cassette 11 to the maintaining roller 13.

In the maintaining roller 13, a thin insulating layer 13*b* is provided on the front surface of a cylinder frame 13*a* as a conductor, for example, made of aluminum. The cylinder frame 13*a* is grounded. The maintaining roller 13 rotates in a direction of arrow s in a state of maintaining the recording sheet P on the front surface, and transports the recording sheet P. The maintaining unit 18 includes a press roller 18*a* which presses the recording sheet P to the maintaining roller 13, and a charging roller 18*b* which causes the recording sheet P to be adsorbed onto the maintaining roller 13 using an electrostatic force due to charging.

The image forming unit 20 includes ink jet heads 20C, 20M, 20Y, and 20K, for example. The ink jet heads 20C, 20M, 20Y, and 20K respectively eject ink of cyan, magenta, yellow, and black, and print a desired image onto the recording sheet P which is maintained on the front surface of the maintaining roller 13.

The separation unit 21 includes a destaticizing charger 21*a* and a separation claw 21*b*. The destaticizing charger 21*a* supplies a charge to the recording sheet P, and performs destaticizing with respect to the recording sheet P. The separation claw 21*b* separates the recording sheet P from the front surface of the maintaining roller 13. When printing ends, the separation unit 21 discharges the recording sheet P which is separated from the maintaining roller 13 to the sheet discharging tray 12 using the transport unit for sheet discharging 17. In a case of double-sided printing, the separation unit 21 reverses the recording sheet P which is separated from the maintaining roller 13 using the reversing unit 16, and supplies the recording sheet to the maintaining roller 13 again. The reversing unit 16 includes a reversing path 16*a* which causes the front-back direction of the recording sheet P to be switched back, for example, and reverses the recording sheet P which is separated from the maintaining roller 13. The cleaning unit 22 cleans the front surface of the maintaining roller 13.

The ink jet heads 20C, 20M, 20Y, and 20K of the image forming unit 20 will be described. The ink jet heads 20C, 20M, 20Y, and 20K have the same configuration even though of which ink to be used is different, respectively. Accordingly, the ink jet head 20C of cyan will be described, and descriptions of the ink jet heads 20M of magenta, 20Y of yellow, and 20K of black will be omitted.

The ink jet head 20C has a thin and long shape which extends in a direction which is orthogonal to the transport direction of the recording sheet P. As illustrated in FIGS. 2 and 3, the ink jet head 20C includes a nozzle plate 100, a pressure chamber structure body 200, and an ink flow path structure body 300. The ink jet head 20C is connected to an ink tank 23, and a control unit 24.

The ink jet head 20C fills ink which is supplied from the ink tank 23 in a pressure chamber 210 of the pressure chamber structure body 200 through the ink flow path structure body 300. The ink jet head 20C ejects ink in the pressure chamber 210 as ink droplets, respectively, from a plurality of nozzles 110 which are formed on the nozzle plate 100, and forms an image onto the recording sheet P. The plurality of nozzles 110 are arranged in the nozzle plate 100 in two rows, for example. A center distance between neighboring nozzles 110 of the nozzle plate 100 is set to 340 μm in the longitudinal direction, and to 240 μm in a short direction, for example.

The ink flow path structure body 300 includes an ink supply port 310, an ink flow path 320, and an ink discharging port 330. The ink flow path structure body 300 discharges ink in the ink flow path 320 which is supplied to the ink supply port 310, and flows into the pressure chamber 210 from the ink flow path 320 to the ink tank 23 from the ink discharging port 330. The ink jet head 20C maintains the temperature of ink to be constant, and suppresses deterioration of ink due to heat by circulating ink between the ink tank 23 and the ink flow path 320.

The nozzle plate 100 includes a driving element 130 which is a driving unit, a protective film 140 which is a protective layer, and an ink repellent film 150 on the vibrating plate 120. The vibrating plate 120 is deformed in the thickness direction due to an operation of the driving element 130 in a planar shape. The ink jet head 20C ejects ink which is supplied to the nozzle 110 due to a pressure change which occurs in the pressure chamber 210 of the pressure chamber structure body 200 due to the deformation of the vibrating plate 120.

The vibrating plate 120 is integrally formed with the pressure chamber structure body 200, for example. When a silicon wafer 201 for manufacturing the pressure chamber structure body 200 is subjected to heating in an oxide atmosphere, a silicon oxide ($SiO_2$) film is formed on the front surface of the silicon wafer 201. In the vibrating plate 120, a silicon oxide ($SiO_2$) film with the thickness of 4 μm on the front surface of the silicon wafer 201 which is formed by being subjected to heating in the oxide atmosphere is used. The vibrating plate 120 may be formed by forming the silicon oxide ($SiO_2$) film on the front surface of the silicon wafer 201 using a chemical vapor deposition (CVD) method.

It is preferable that the film thickness of the vibrating plate 120 be set to a range of 1 μm to 50 μm. In the vibrating plate 120, it is possible to use a semiconductor material such as silicon nitride (SiN), aluminum oxide ($Al_2O_3$), or the like, instead of the silicon oxide ($SiO_2$) film.

There are a plurality of driving elements 130 for each nozzle 110, and the driving element includes a lower electrode 131 and an upper electrode 133 by interposing a piezoelectric film 132 which is a piezoelectric substance therebetween. The driving element 130 includes an insulating film 134 which insulates between the lower electrode 131 and the upper electrode 133. When the lower electrode 131 is set to a common electrode, for example, the upper electrode 133 is set to a wiring electrode for each driving element 130. The upper electrode 133 may be set to the common electrode, and the lower electrode 131 may be set to the wiring electrode. A shape of the driving element 130 is a ring surrounding the nozzle 110. The shape of the driving element 130 is not limited, and for example, the shape may also be a C shape in which a part of a ring is cut out.

The lower electrode 131 includes a plurality of circular electrode units 131*a* with the same axes to the plurality of circular nozzles 110, respectively. For example, a diameter of the nozzle 110 is set to 20 μm, and an outer diameter of the electrode unit 131*a* is set to 172 μm. An inner diameter of the electrode unit 131*a* is set to 42 μm, for example. The lower electrode 131 connects the plurality of electrode units 131*a*, includes a wiring unit 131*b* which extends in a short direction of the nozzle plate 100, and includes two terminal units 131*c* at an end portion of the wiring unit 131*b*.

The driving element 130 includes the piezoelectric film 132 which is formed of lead zirconate titanate (PZT ($Pb(Zr,Ti)O_3$)), and is a piezoelectric material of which the thickness is 1 μm, for example, on the electrode unit 131*a*. The piezoelectric film 132 has the same axis to the nozzle 110, and has a ring shape of which an outer diameter is 176 μm which is larger than that of the electrode unit 131*a*, and of which an inner diameter is 38 μm. The film thickness of the piezoelectric film 132 is approximately 1 μm to 5 μm. In the piezoelectric film 132, it is also possible to use a piezoelectric material such as lead titanate (PTO ($PbTiO_3$)), PMNT ($Pb(Mg_{1/3}Nb_{2/3})O_3$—$PbTiO_3$), PZNT ($Pb(Zn_{1/3}Nb_{2/3})O_3$—$PbTiO_3$), ZnO, and AlN.

The piezoelectric film 132 generates polarization in the thickness direction. When an electric field in the same direction as the polarization is applied to the piezoelectric film 132, the piezoelectric film 132 extends and contracts in a direction orthogonal to the electric field direction. In other words, the piezoelectric film 132 contracts or extends in a direction orthogonal to the film thickness.

The upper electrode 133 of the driving element 130 includes a circular electrode unit 133*a* which has the same axis to the nozzle 110, and is larger than the piezoelectric film 132 on the piezoelectric film 132. The electrode unit 133*a* is formed so as to have an outer diameter of 180 μm, and an inner diameter of 34 μm, for example. The upper electrode 133 includes a plurality of wiring units 133*b* which extend in a short direction of the nozzle plate 100 from each of the electrode units 133*a*, for example, and a terminal unit 133*c* of an end portion of the wiring unit 133*b*. The plurality of terminal units 133*c* are arranged in line between two terminal units 131*c* of the lower electrode 131. The control unit 24 controls ON-OFF of a voltage which is applied to the wiring unit 133*b*.

The lower electrode 131 is formed so as to have the thickness of 0.5 μm by laminating titanium (Ti) and platinum (Pt) using a sputtering method, for example. The film thickness of the lower electrode 131 is in a range of approximately 0.01 μm to 1 μm. In the lower electrode 131, it is also possible to use another material such as nickel (Ni), copper (Cu), aluminum (Al), titanium (Ti), tungsten (W), molybdenum (Mo), or gold (Au). It is also possible to use a lamination of various metal in the lower electrode 131.

The upper electrode 133 is formed of a thin film of Pt. The thin film is formed using a sputtering method, and the thickness of the film is set to 0.5 μm. As another electrode material of the upper electrode 133, it is also possible to use Ni, Cu, Al, Ti, W, Mo, Au, or the like. As another film forming method, it is also possible to use deposition, or plating. It is preferable to set the film thickness of the plurality of wiring electrodes 103 to 0.01 μm to 1 μm.

The insulating film 134 is partially formed on the lower electrode 131 and the piezoelectric film 132. In the insulating film 134, silicon oxide ($SiO_2$) with the thickness of 0.2 μm is used, for example.

The nozzle plate 100 includes a protective film 140 of polyimide, for example, which protects the driving element 130. The protective film 140 includes an ink passage unit 141 which communicates with the nozzle 110 of the vibrating plate 120. The ink passage unit 141 has a diameter of 20 μm which is the same as that of the nozzle 110 of the vibrating plate 120.

In the protective film 140, it is possible to use another resin, or another insulating material such as a ceramic. As another resin, there is acrylonitrile-butadiene-styrene (ABS), polyacetal, polyamide, polycarbonate, polyethersulphone, or the like. As the ceramic, there is zirconia, silicon carbide, silicon nitride, or the like, for example. The film thickness of the protective film 140 is in a range of approximately 3 μm to 50 μm.

In addition, when selecting a material of the protective film 140, it is preferable to select a material in which a difference in Young's modulus from the material of the vibrating plate 120 is large, that is, a material in which a difference in Young's modulus between the vibrating plate 120 and the protective film 140 is large. A deformation amount in a plate shape is influenced by Young's modulus of a plate material, and the plate thickness. The smaller the Young's modulus, and the thinner the plate thickness, the larger the deformation, even when the same force is applied. According to the embodiment, Young's modulus of $SiO_2$ film of the vibrating plate 120 is 80.6 GPa, and Young's modulus of a polyimide film of the protective film 140 is 10.9 GPa, and there is a difference in Young's modulus of 69.7 GPa. The reason of this will be described.

The ink jet head 20C according to the embodiment has a structure in which the driving element 130 is interposed between the vibrating plate 120 and the protective film 140, and when the driving element 130 extends in a direction orthogonal to the electric field direction by being applied with an electric field, the vibrating plate 120 is loaded with a force which causes the vibrating plate to deform in a concave shape with respect to the pressure chamber 210 side. In contrast to this, the protective film 140 is loaded with a force which causes the protective film 140 to deform in a convex shape with respect to the pressure chamber 210 side. When the driving element 130 contracts in the direction orthogonal to the electric field direction, the vibrating plate 120 is loaded with a force which causes the vibrating plate to deform in a convex shape with respect to the pressure chamber 210 side, and the protective film 140 is loaded with a force which causes the protective film to deform in a concave shape with respect to the pressure chamber 210 side. That is, when the driving element 130 extends and contracts in the direction orthogonal to the electric field direction, the vibrating plate 120 and the protective film 140 are loaded with forces which cause the vibrating plate and the protective film to deform in the opposite direction. Therefore, when the film thicknesses and Young's moduli of the vibrating plate 120 and the protective film 140 are the same, since a load which deforms the vibrating plate 120 and the protective film 140 in the opposite direction, and by the same amount is applied, even when a voltage is applied to the driving element 130, the nozzle plate 100 is not deformed, and ink is not ejected.

According to the embodiment, since Young's modulus of the polyimide film of the protective film 140 is smaller than that of the $SiO_2$ film of the vibrating plate 120, a deformation amount of the protective film 140 with respect to the same force becomes large. In the structure of the embodiment, when the driving element 130 extends in the direction orthogonal to the electric field direction, the nozzle plate 100 is deformed into the convex shape with respect to the pressure chamber 210 side, and a capacity of the pressure chamber 210 decreases (since amount of deforming into convex shape of protective film 140 with respect to pressure chamber 210 side is large). In contrast to this, when the driving element 130 contracts in the direction orthogonal to the electric field direction, the nozzle plate 100 is deformed into the concave shape with respect to the pressure chamber 210 side, and the capacity of the pressure chamber 210 increases (since amount of deforming into concave shape of protective film 140 with respect to pressure chamber 210 side is large).

Due to an application of a voltage to the driving element 130, the vibrating plate 120 is deformed, and causes the capacity of the pressure chamber 210 to be changed. When the capacity of the pressure chamber 210 increases, a negative pressure is generated in ink in the pressure chamber 210, and the ink flows into the pressure chamber 210 from the ink flow path 320. When the capacity of the pressure chamber 210 decreases, the ink in the pressure chamber 210 is ejected from the nozzle 110 by being pressurized.

If the difference in Young's modulus between the vibrating plate 120 and the protective film 140 is large, the difference in the deformation amount of the vibrating plate becomes larger when the same voltage is applied to an actuator. For this reason, it is possible to eject ink of a lower voltage condition when the difference in Young's modulus between the vibrating plate 120 and the protective film 140 is large.

In addition, as described above, the deformation amount of the plate shape is also influenced by the plate thickness, not only by Young's modulus of a material of the plate. For this reason, when making the deformation amount of the vibrating plate 120 and the protective film 140 different, it is also necessary to take the respective film thicknesses into consideration, not only the Young's modulus of the material. Even when Young's moduli of the materials of the vibrating plate 120 and the protective film 140 are the same, if the film thicknesses are different, ink can be ejected even under a high voltage condition.

In addition to this, when selecting a material of the protective film 140, heat resistance, an insulation property (considering influence of ink deterioration due to contact with upper electrode 133, when driving element 130 in case of using highly conductive ink), thermal expansion coefficient, flatness, and wettability with respect to ink are taken into consideration.

The nozzle plate 100 includes the ink repellent film 150 which covers the protective film 140. The ink repellent film 150 is formed by performing spin coating with respect to, for example, a silicone-based resin which has a property of repelling ink. The ink repellent film 150 can also be formed using a material with a property of repelling ink such as a resin containing fluorine. The thickness of the ink repellent film 150 in a region except for the driving element 130 when the ink repellent film 150 is spin-coated is, for example, 1 μm.

The pressure chamber structure body 200 with the thickness of 525 μm which is formed using the silicon wafer 201 includes a warpage reducing film 220 which is a warpage reducing layer on a face which faces the vibrating plate 120. The pressure chamber structure body 200 reaches a position of the vibrating plate 120 by penetrating the warpage reducing film 220, and includes the pressure chamber 210 which communicates with the nozzle 110. A side on which the vibrating plate 120 of the pressure chamber 210 is arranged is set to a first face, and a side on which the warpage reducing film 220 is arranged is set to a second face.

The ink flow path structure body 300 is bonded to the warpage reducing film 220 side of the pressure chamber structure body 200 using, for example, an epoxy-based adhesive. The pressure chamber 210 of the pressure chamber structure body 200 communicates with the ink flow path 320 of the ink flow path structure body 300 on the warpage reducing film 220 side. The pressure chamber 210 is formed in a circular shape with a diameter of 240 μm which is located on the same axis of the nozzle 110, for example. A shape and a size of the pressure chamber 210 are not limited.

However, as in the first embodiment, when a separate plate in which an ink supply hole with a hole diameter smaller than that of the pressure chamber 210 is formed is not provided between the pressure chamber 210 and the ink flow path 320, it is preferable to set a size L in the depth direction to be larger than a size D in the width direction of the pressure chamber 210. By setting the size L in the depth direction to be larger than the size D in the width direction, it is possible to put off escaping of a pressure applied to ink in the pressure chamber 210 to the ink flow path 320 due to vibrating of the vibrating plate 120 of the nozzle plate 100. In addition, the ink jet head 20C may have a structure in which a pressure applied to ink in the pressure chamber 210 does not escape to the ink flow path 320 by including a separate plate between the pressure chamber 210 and the ink flow path 320.

As the warpage reducing film 220, a silicon oxide ($SiO_2$) film with the thickness of 4 μm which is formed on the front surface of the silicon wafer 201 is used by heating the silicon wafer 201 for manufacturing the pressure chamber structure body 200 in an oxide atmosphere, for example. The warpage reducing film 220 may be formed by forming a silicon oxide ($SiO_2$) film with respect to the front surface of the silicon wafer 201 using a chemical vapor deposition (CVD) method. The warpage reducing film 220 reduces warpage which occurs in the ink jet head 20C.

In general, there is a concern that warpage may occur in the ink jet head when creating a constituent member of the ink jet head on the substrate using a film forming process, for example. There is a concern that warpage in the ink jet head may occur when the constituent member is formed only on one face of the substrate, in a case in which there is a difference in membrane stresses between the silicon wafer which is a substrate, for example, and the constituent member. The larger the film thickness of the constituent member, the larger the amount of warpage in the ink jet head.

When warpage occurs in the ink jet head, there is a concern that an ejecting angle of ink (ejecting direction) from nozzles on both sides of the ink jet head in the longitudinal direction may be deviated from a desired direction. When the ejecting angle of ink is deviated, a landing position of ink is deviated, and there is a concern that an image quality may deteriorate due to deterioration in precision in printing of the ink jet head.

In addition, if warpage is forcibly corrected using a force when the warpage occurs in the ink jet head, stress distortion remains in the ink jet head. For this reason, the stress distortion in the ink jet head is exposed while using the ink jet head, and there is a concern that the ink jet head may be damaged due to a crack which occurs in the ink jet head.

In addition, if the substrate is bent when manufacturing the inkjet head, there is also a case in which a defect occurs due to a failure of fixing the substrate to an apparatus.

The warpage reducing film 220 is located on aside facing the vibrating plate 120 side of the silicon wafer 201, and reduces warpage of the silicon wafer 201. The warpage reducing film 220 reduces a difference in membrane stresses between the pressure chamber structure body 200 and the vibrating plate 120, and reduces warpage of the silicon wafer 201 which is caused by a difference in membrane stresses in various constituent films of the driving element 130. The warpage reducing film 220 reduces warpage of the inkjet head 20C when the constituent member of the ink jet head 20C is created using the film forming process.

A material, the film thickness, and the like, of the warpage reducing film 220 may be different from those of the vibrating plate 120. However, when the material and the film thickness of the warpage reducing film 220 are set to be the same as those of the vibrating plate 120, a difference in a membrane stress from the vibrating plate 120 and a difference in a membrane stress from the warpage reducing film 220 at both faces of the silicon wafer 201 become the same. When the warpage reducing film 220 and the vibrating plate 120 are formed using the same material and the same film thickness, it is possible to more effectively reduce the warpage which occurs in the ink jet head 20C.

An example of a manufacturing method of the ink jet head 20C will be described. In the ink jet head 20C, first, a silicon oxide ($SiO_2$) film is formed on all of both faces of the silicon wafer 201 for forming the pressure chamber structure body 200. The silicon oxide ($SiO_2$) film which is formed on one face of the silicon wafer 201 is used as the vibrating plate 120. The silicon oxide ($SiO_2$) film which is formed on the other face of the silicon wafer 201 is used as the warpage reducing film 220.

The silicon oxide ($SiO_2$) film is formed on both faces of the silicon wafer 201 which is disciformed, for example, using a thermal oxidation method in which heating is performed in an oxide atmosphere, using a batch type reactor, for example.

A plurality of the nozzle plates 100, and the pressure chamber 210 which is integral with the nozzle plate 100 are formed in the disciform silicon wafer 201 using the film forming process. After forming the nozzle plate 100 and the pressure chamber 210, the disciform silicon wafer 201 is cut, and is separated into a plurality of pressure chamber structure bodies 200 which is integral with the nozzle plate 100. It is possible to manufacture the plurality of ink jet heads 20C in large quantities at a time using the disciform silicon wafer 201. The silicon wafer 201 may not be disciformed. The nozzle plate 100 and the pressure chamber structure body 200 which are integrated may be formed individually using one rectangular silicon wafer 201.

The nozzle 110 is formed by patterning the vibrating plate 120 which is formed on the silicon wafer 201 using an etching mask. In the pattering, a photoresist is used as a material of the etching mask. The photoresist is applied to the front surface of the vibrating plate 120, is exposed and developed, and an opening portion corresponding to the nozzle 110 is patterned, thereby forming the etching mask. When forming the nozzle 110, dry etching is performed on the etching mask until the vibrating plate 120 reaches the pressure chamber structure body 200. After forming the nozzle 110 on the vibrating plate, the etching mask is removed using a peeling solution, for example.

Subsequently, the nozzle 110, the driving element 130, the protective film 140, and the ink repellent film 150 are formed on the front surface of the vibrating plate 120 on which the nozzle 110 is formed. When forming the nozzle 110, the driving element 130, the protective film 140, and the ink repellent film 150, a film forming process and a patterning process are repeated. The film forming process is performed using a sputtering method, a CVD method, or the like. When performing the patterning, an etching mask is formed on a film using a photoresist, for example, a film material is etched, and the etching mask is removed.

In the vibrating plate 120, a titanium (Ti) film with the thickness of 0.45 μm, and a platinum (Pt) film with the thickness of 0.05 μm are formed in order using a sputtering method as a material of the lower electrode 131. The titanium (Ti) film and the platinum (Pt) film may be formed using a deposition method or by plating. An etching mask for causing the electrode unit 131*a*, the wiring unit 131*b*, and the terminal unit 131*c* to be remained is created on the formed titanium (Ti) film and the formed platinum (Pt) film. The titanium (Ti) film and the platinum (Pt) film are removed by performing etching from the etching mask, and the lower electrode 131 is formed.

As a material of the piezoelectric film 132, lead zirconate titanate (PZT ($Pb(Zr,Ti)O_3$)) film with the thickness of 1 μm is formed on the vibrating plate 120 on which the lower electrode 131 is formed using an RF-magnetron sputtering method at a substrate temperature of 350° C. After forming the PZT film, it is possible to obtain a good piezoelectric performance of the PZT film by heating the film for three hours at a temperature of 500° C. The PZT film may be formed using the chemical vapor deposition (CVD) method, a sol-gel method, an aerosol deposition (AD) method, and a hydrothermal method.

An etching mask for causing the piezoelectric film 132 to be remained is created on the formed PZT film. Etching is performed on the etching mask, and the PZT film is removed, thereby forming the piezoelectric film 132.

A silicon oxide ($SiO_2$) film with the thickness of 0.2 μm is formed on the vibrating plate 120 on which the piezoelectric film 132 is formed, as a material of the insulating film 134. The silicon oxide ($SiO_2$) film obtains a good insulation property by being formed at a low temperature using the CVD method, for example. The insulating film 134 is formed by pattering the formed silicon oxide ($SiO_2$) film. The insulating film 134 partially covers the piezoelectric film 132 in order to suppress malfunction which is caused by uneven patterning. The insulating film 134 partially covers the piezoelectric film 132 to an extent of not inhibiting a deformation amount of the piezoelectric film 132.

A platinum (Pt) film with the thickness of 0.5 μm is formed on the vibrating plate 120 on which the insulating film 134 is formed using the sputtering method, as a material of the upper electrode 133. An etching mask for causing the electrode unit 133*a*, the wiring unit 133*b*, and the terminal unit 133*c* to be remained is created on the formed platinum (Pt) film. Etching is performed on the etching mask, and the platinum (Pt) film is removed, thereby forming the upper electrode 133.

A polyimide film which is a material of the protective film 140 with the thickness of 4 μm is formed on the vibrating plate 120 on which the upper electrode 133 is formed. When forming the polyimide film, a solution including polyimide precursor is applied onto the vibrating plate 120 using a spin coating method, thermal polymerization using baking is performed, and a solvent is removed. The formed polyimide film is patterned, and the protective film 140 which exposes the ink passage unit 141, the terminal unit 131*c* of the lower electrode 131, and the terminal unit 133*c* of the upper electrode 133 is formed.

The protective film 140 is protected by bonding, for example, a rear face protecting tape for chemical-mechanical planarization (CMP) of the silicon wafer 201 onto the protective film 140, as a cover tape, and the pressure chamber structure body 200 is patterned. An etching mask for exposing a diameter of 240 μm of the pressure chamber 210 is formed on the warpage reducing film 220 of the silicon wafer 201, and first, the warpage reducing film 220 is subjected to dry etching using mixed gas of four fluorinated carbon (CF 4) and oxygen ($O_2$). Subsequently, vertical trench dry etching which is exclusive to the silicon wafer is performed using mixed gas of six silicon fluoride ($SF_6$) and $O_2$, for example. The dry etching stops at a position of coming into contact with the vibrating plate 120, and forms the pressure chamber 210 in the pressure chamber structure body 200.

The etching which forms the pressure chamber 210 may be performed by a wet etching method using a drug solution, a dry etching method using plasma, or the like. After finishing the etching, the etching mask is removed. After forming the pressure chamber 210, the ink flow path structure body 300 is bonded to the warpage reducing film 220 side of the pressure chamber structure body 200.

After bonding the ink flow path structure body 300 to the pressure chamber structure body 200, adhesiveness of the cover tape which is adhered onto the protective film 140 is weakened by being irradiated with UV light, and the cover tape is separated from the protective film 140.

An electrode terminal cover tape is bonded to the terminal unit 131*c* of the lower electrode 131 and the terminal unit 133*c* of the upper electrode 133 which are exposed on the vibrating plate 120, without forming the protective film 140. As the electrode terminal cover tape, for example, a resinous adhesive tape which is easily separated is used. A silicone-based resin film with the thickness of 1 μm which is a material of the ink repellent film 150 is formed on the protective film 140 using a spin coating method.

Positive pressure air is injected from the ink supply port 310 of the ink flow path structure body 300 while the ink repellent film 150 is formed. By injecting positive pressure air in the ink supply port 310, positive pressure air is discharged from the nozzle 110 through the ink flow path 320 and the pressure chamber 210. By forming the ink repellent film 150 while discharging positive pressure air from the nozzle 110, it is possible to prevent a material of the ink repellent film 150 from adhering to the inner peripheral surface of the nozzle 110. After forming the ink repellent film 150 on the protective film 140, the electrode terminal cover tape is taken off, the disciform silicon wafer 201 is cut, and the silicon wafer is formed into a plurality of ink jet heads 20C by being separated. The inkjet heads 20M, 20Y, and 20K of magenta, yellow, and black are formed similarly to the ink jet head 20C of cyan.

The respectively formed ink jet heads 20C, 20M, 20Y, and 20K are mounted to the image forming unit 20 of the ink jet printer 10. The terminal unit 133*c* of the upper electrode 133 is connected to the control unit 24 through a flexible cable, for example. The ink supply port 310 of the ink flow path structure body 300 and the ink discharging port 330 are connected to the ink tank 23 through a tube, for example.

When printing starts by setting the recording sheet P in the sheet feeding cassette 11 of the ink jet printer 10, the transport unit for sheet feeding 14 transports the recording sheet P to a location between the maintaining unit 18 and the maintaining roller 13. The maintaining roller 13 which rotates in the arrows direction transports the recording sheet P to the image forming unit 20 using an electrostatic force which is provided to the maintaining unit 18. The ink jet heads 20C, 20M, 20Y, and 20K of the image forming unit 20 form a printed image onto the recording sheet P by ejecting ink from the nozzle 110, respectively, due to a control of the control unit 24.

Since the ink jet heads 20C, 20M, 20Y, and 20K include the warpage reducing film 220, warpage in the longitudinal direction is reduced. The ink jet heads 20C, 20M, 20Y, and 20K in which warpage is reduced eject ink at a desired ejecting angle from the nozzle 110 on both sides in the longitudinal direction. The nozzle 110 of the inkjet heads 20C, 20M, 20Y, and 20K maintains a uniform ejecting angle over the entire length in the longitudinal direction. Landing positions of ink on the recording sheet P using the inkjet heads 20C, 20M, 20Y, and 20K are maintained at desired positions over the entire length in the longitudinal direction.

When performing printing in the image forming unit 20, the ink jet heads 20C, 20M, 20Y, and 20K in which warpage is reduced realize uniform printing precision over the entire length in the longitudinal direction, and print a good printed image.

After forming a printed image using the ink jet heads 20C, 20M, 20Y, and 20K, the maintaining roller 13 transports the recording sheet P to the separation unit 21. The recording sheet P which is separated from the maintaining roller 13 due to the separation unit 21 is branched in a direction of the transport path for sheet discharging 17 due to the separation claw 21*b* when printing is ended. The transport path for sheet discharging 17 discharges the recording sheet P to the sheet discharging tray 12, and the printing operation ends.

When printing is performed on the rear surface of the recording sheet P, the recording sheet P which is separated from the maintaining roller 13 is branched in a direction of the reversing unit 16 due to the separation claw 21*b*. The recording sheet P which is reversed in the reversing unit 16 is transported again to the location between the maintaining unit 18 and the maintaining roller 13, is discharged to the sheet discharging tray 12 after ending of printing on the rear surface, and the printing operation ends.

According to the first embodiment, respective pressure chamber structure bodies 200 of the ink jet heads 20C, 20M, 20Y, and 20K include the warpage reducing film 220 on a side facing the vibrating plate 120. Since the pressure chamber structure body 200 includes the warpage reducing film 220, it is possible to reduce warpage of the ink jet heads 20C, 20M, 20Y, and 20K in the longitudinal direction, even when the nozzle plate 100 is formed in the pressure chamber structure body 200 by repeating the film forming process.

The ink jet heads 20C, 20M, 20Y, and 20K in which warpage is reduced obtain a uniform ejecting angle of ink from the nozzle 110 over the entire length in the longitudinal direction. The ink jet heads 20C, 20M, 20Y, and 20K can eject ink at a desired landing position over the entire length in the longitudinal direction. The ink jet heads 20C, 20M, 20Y, and 20K can obtain uniform printing precision over the entire length in the longitudinal direction, and provide a good printed image.

In addition, it is possible to prevent the inkjet heads from being damaged due to internal stress distortion which occurs when warpage of the ink jet heads 20C, 20M, 20Y, and 20K is forcibly corrected, and to realize long life of the ink jet heads 20C, 20M, 20Y, and 20K.

The warpage reducing film 220 according to the first embodiment is formed of the same material as that of the vibrating plate 120, and has the same film thickness. A difference in a membrane stress between the pressure chamber structure body 200 and the vibrating plate 120, and a difference in a membrane stress between the pressure chamber structure body 200 and the warpage reducing film 220 are the same, and membrane stresses which occur on both faces of the pressure chamber structure body 200 become approximately the same. By setting the same material and the same film thickness with respect to the warpage reducing film 220 and the vibrating plate 120, it is possible to further reliably reduce warpage of the ink jet heads 20C, 20M, 20Y, and 20K.

According to the first embodiment, silicon oxide ($SfO_2$) films are obtained on both faces of the silicon wafer 201 by processing the silicon wafer 201 using a thermal oxidation method. The silicon oxide ($SfO_2$) film which is formed on one face of the silicon wafer 201 is set to the vibrating plate 120, and the silicon oxide ($SiO_2$) film which is formed on the other face of the silicon wafer 201 is set to the warpage reducing film 220. It is possible to manufacture the vibrating plate 120 and the warpage reducing film 220 on both faces of the silicon wafer 201 at the same time, and it is possible to make the manufacturing process simple.

Second Embodiment

An ink jet head 400 according to a second embodiment will be described with reference to FIG. 4. According to the second embodiment, nozzles are formed on a protective film, without forming nozzles on the vibrating plate as in the first embodiment. In the second embodiment, the same configurations as those which are described in the first embodiment are given the same reference numerals, and detailed descriptions thereof will be omitted.

Figure 4:
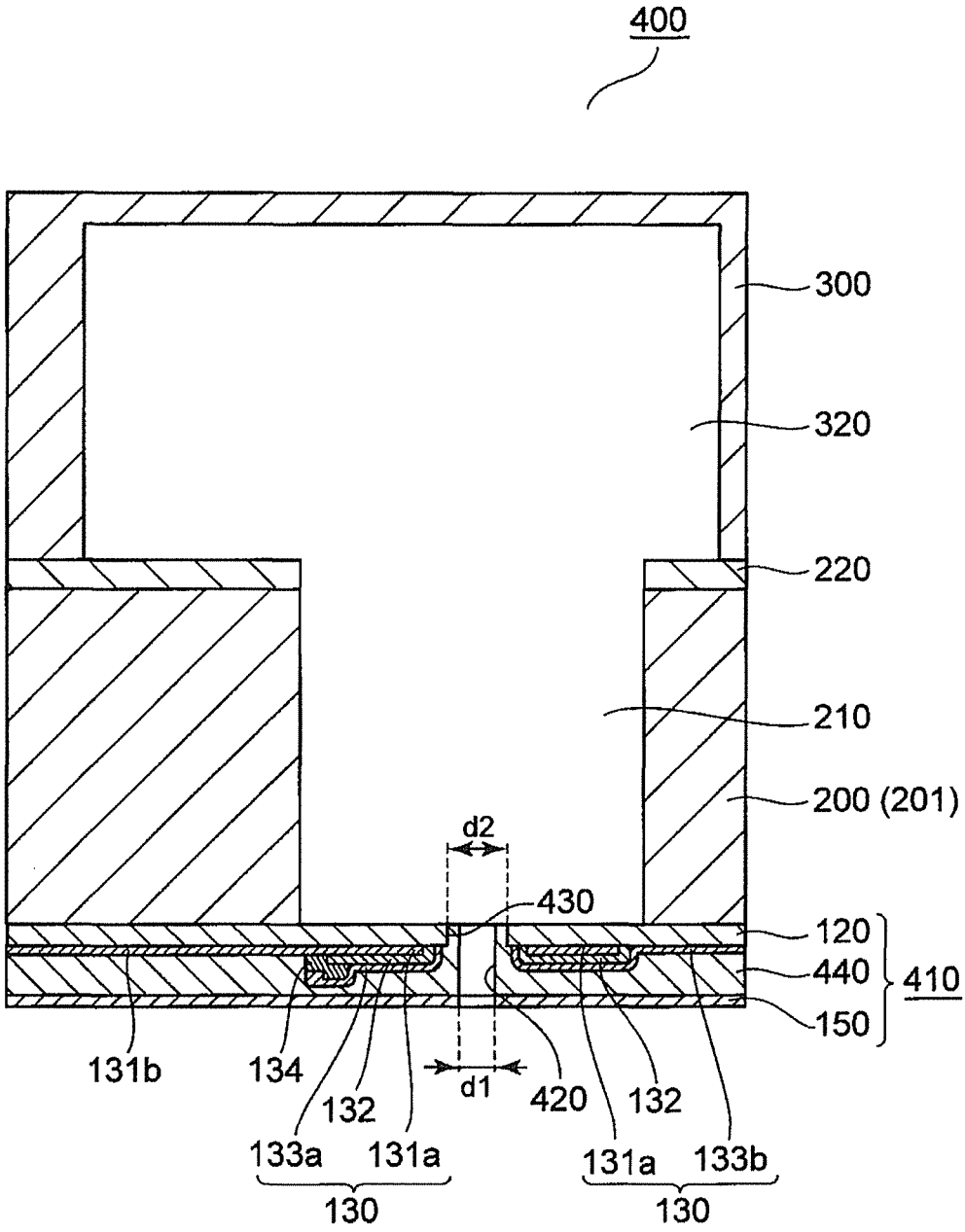
FIG. 4 is a schematic cross-sectional view which illustrates an ink jet head according to a second embodiment.

As illustrated in FIG. 4, a vibrating plate 120 of a nozzle plate 410 of the ink jet head 400 includes a peripheral hole 430 with a diameter d2 which is open at the same axis position of a nozzle 420 with a diameter d1. The diameter d2 of the peripheral hole 430 is larger than the diameter d1 of the nozzle 420. The nozzle plate 410 includes a protective film 440 on the vibrating plate 120 in which a driving element 130 is formed. The protective film 440 covers the inner peripheral surface of the peripheral hole 430, and communicates with the pressure chamber 210. In the protective film 440, the nozzle 420 with a diameter of 20 μm, for example, is formed. The peripheral hole 430 communicates with the pressure chamber 210 through the protective film 440.

When manufacturing the ink jet head 400, the peripheral hole 430 is formed by patterning the vibrating plate 120 which is integrated with the silicon wafer 201, using an etching mask. A polyimide film is formed after forming the driving element 130 in the vibrating plate 120. The protective film 440 which includes the nozzle 420 is formed by patterning the polyimide film. The protective film 440 exposes a terminal unit 131*c* of a lower electrode 131, and a terminal unit 133*c* of an upper electrode 133.

For example, according to the first embodiment, there is a concern that shapes of the nozzle 110 and the ink passage unit 141 may be ununiform since the nozzle 110 and the ink passage unit 141 with the same axis and the same diameter are respectively patterned. When the nozzle 110 and the ink passage unit 141 are ununiform, there is a concern that a landing position of ink droplets which are ejected from the nozzle 110 may be deviated. In contrast to this, the nozzle 420 in the second embodiment is formed using one pattern which is performed with respect to the protective film 440. Therefore, the inner peripheral surface of the nozzle 420 can be formed uniformly. There is no concern that a landing position of ink droplets which are ejected from the nozzle 420 is deviated, and it is possible to obtain high printing precision when performing printing using the ink jet head 400.

According to the second embodiment, since the ink jet head 400 includes the warpage reducing film 220 similarly to the first embodiment, it is possible to reduce warpage of the ink jet head 400 in the longitudinal direction. It is possible for the ink jet head 400 to obtain a uniform ink ejecting angle over the entire length in the longitudinal direction, and to provide a good printed image by obtaining uniform printing precision.

In addition, in the ink jet head 400, the nozzle 420 is formed in the protective film 440 which covers the inner peripheral surface of the peripheral hole 430 of the vibrating plate 120, by performing patterning once. It is possible to make the inner peripheral surface of the nozzle 420 which communicates with the pressure chamber 210 uniform, and maintain precision in a landing position of ink droplets which are ejected from the nozzle 420. When performing printing, the ink jet head 400 realizes high printing precision.

Third Embodiment

An ink jet head 500 according to a third embodiment will be described with reference to FIG. 5. In the third embodiment, an ink passage unit which has the same axis to a nozzle and has a larger diameter than that of the nozzle is formed in the protective film in the first embodiment. In the third embodiment, the same configurations as those which are describe in the first embodiment will be given the same reference numerals, and detailed descriptions thereof will be omitted.

Figure 5:
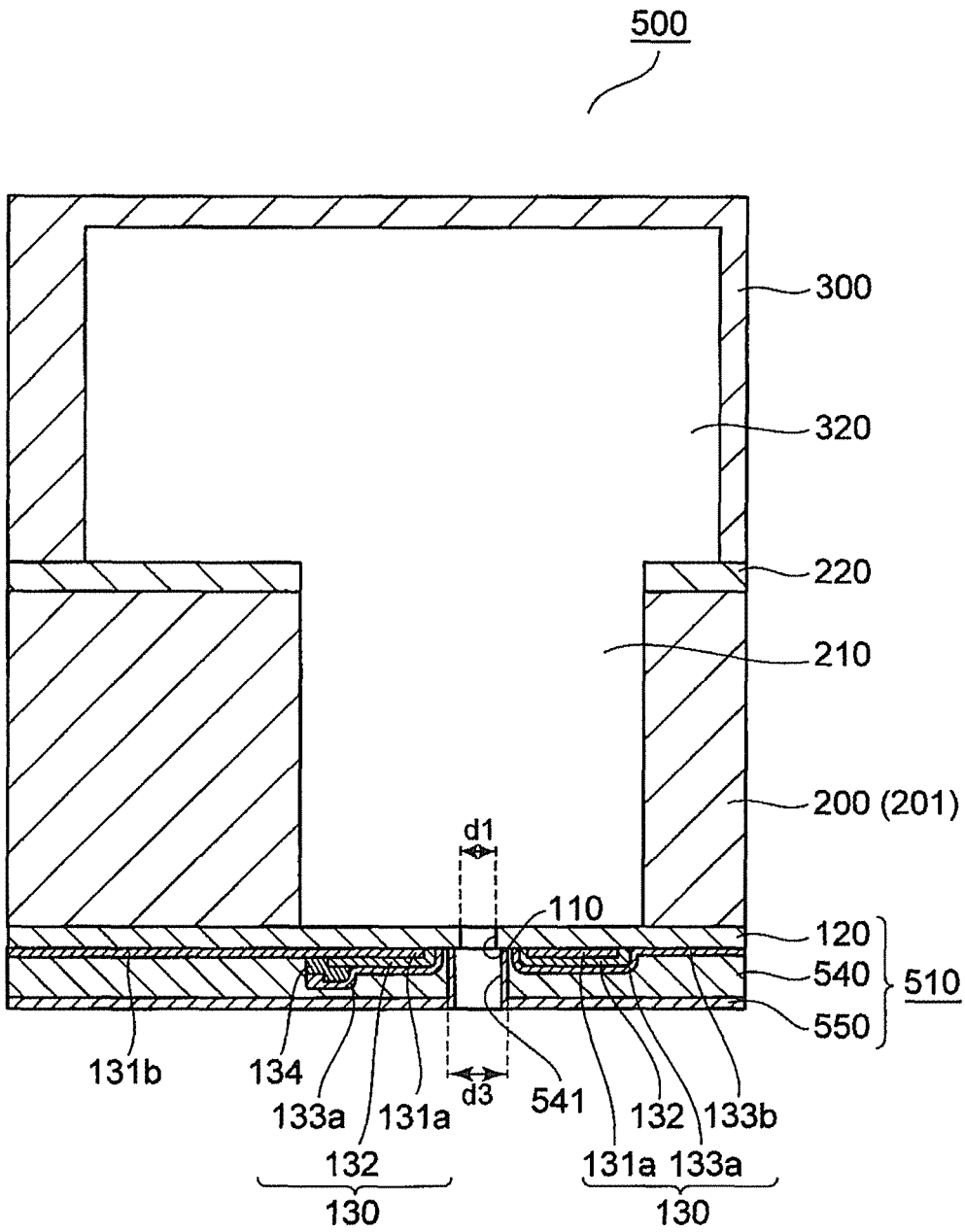
FIG. 5 is a schematic cross-sectional view which illustrates an ink jet head according to a third embodiment.

As illustrated in FIG. 5, a nozzle plate 510 of an ink jet head 500 includes a nozzle 110 with a diameter of d1 and a driving element 130 on a vibrating plate 120, and further includes a protective film 540 and an ink repellent film 550. The protective film 540 has an ink passage unit 541 which has the same axis to the nozzle 110, and of which a diameter d3 is larger than the diameter of the nozzle 110. For example, the diameter d1 of the nozzle 110 is set to 20 μm, and the diameter d3 of the ink passage unit 541 is set to 30 μm. The nozzle plate 510 includes the ink repellent film 550 on the protective film 540. The ink repellent film 550 covers the front surface of the ink passage unit 541 of the protective film 540, and communicates with the nozzle 110. The ink passage unit 541 communicates with the nozzle 110 through the ink repellent film 550.

When manufacturing the ink jet head 500, a polyimide film is formed after forming the driving element 130 of the vibrating plate 120 which includes the nozzle 110. The protective film 540 which includes the ink passage unit 541 is formed by patterning the polyimide film. The protective film 540 exposes a terminal unit 131*c* of a lower electrode 131, and a terminal unit 133*c* of an upper electrode 133. The ink repellent film 550 is formed on the protective film 540 while discharging positive pressure air from the nozzle 110. The ink repellent film 550 does not adhere to the inner peripheral surface of the nozzle 110, and covers the front surface of the protective film 540.

For example, according to the first embodiment, when patterning of the nozzle 110 and the ink passage unit 141 of which axes and diameters are the same is ununiform, there is a concern that a landing position of the ink droplets which are ejected from the nozzle 110 may be deviated. In contrast to this, in the third embodiment in which the diameter of the ink passage unit 541 is larger than that of the nozzle 110, there is no concern that the landing position of the ink droplets may be deviated even when patterning of the nozzle 110 and the ink passage unit 541 is a little ununiform.

According to the third embodiment, since the ink jet head 500 includes the warpage reducing film 220 similarly to the first embodiment, it is possible to reduce warpage of the ink jet head 500 in the longitudinal direction. Since the ink jet head 500 obtains a uniform ink ejecting angle over the entire length in the longitudinal direction, and obtains uniform printing precision, it is possible to provide a good printed image.

In addition, the ink jet head 500 is formed so that the diameter of the ink passage unit 541 which is formed in the protective film 540 is larger than that of the nozzle 110. Even when patterning of the nozzle 110 is deviated from that of the ink passage unit 541, the ink droplets which are ejected from the nozzle 110 are not influenced by the ink passage unit 541. The ink droplets from the nozzle 110 maintain precision in a landing position, and the ink jet head 500 realizes high printing precision when performing printing.

Fourth Embodiment

An ink jet head 600 according to a fourth embodiment will be described with reference to FIG. 6. In the fourth embodiment, the inner peripheral surface of the ink passage unit which is formed in the protective film in the third embodiment is formed to be inclined. In the fourth embodiment, the same configurations as those which are described in the third embodiment will be given the same reference numerals, and detailed descriptions thereof will be omitted.

Figure 6:
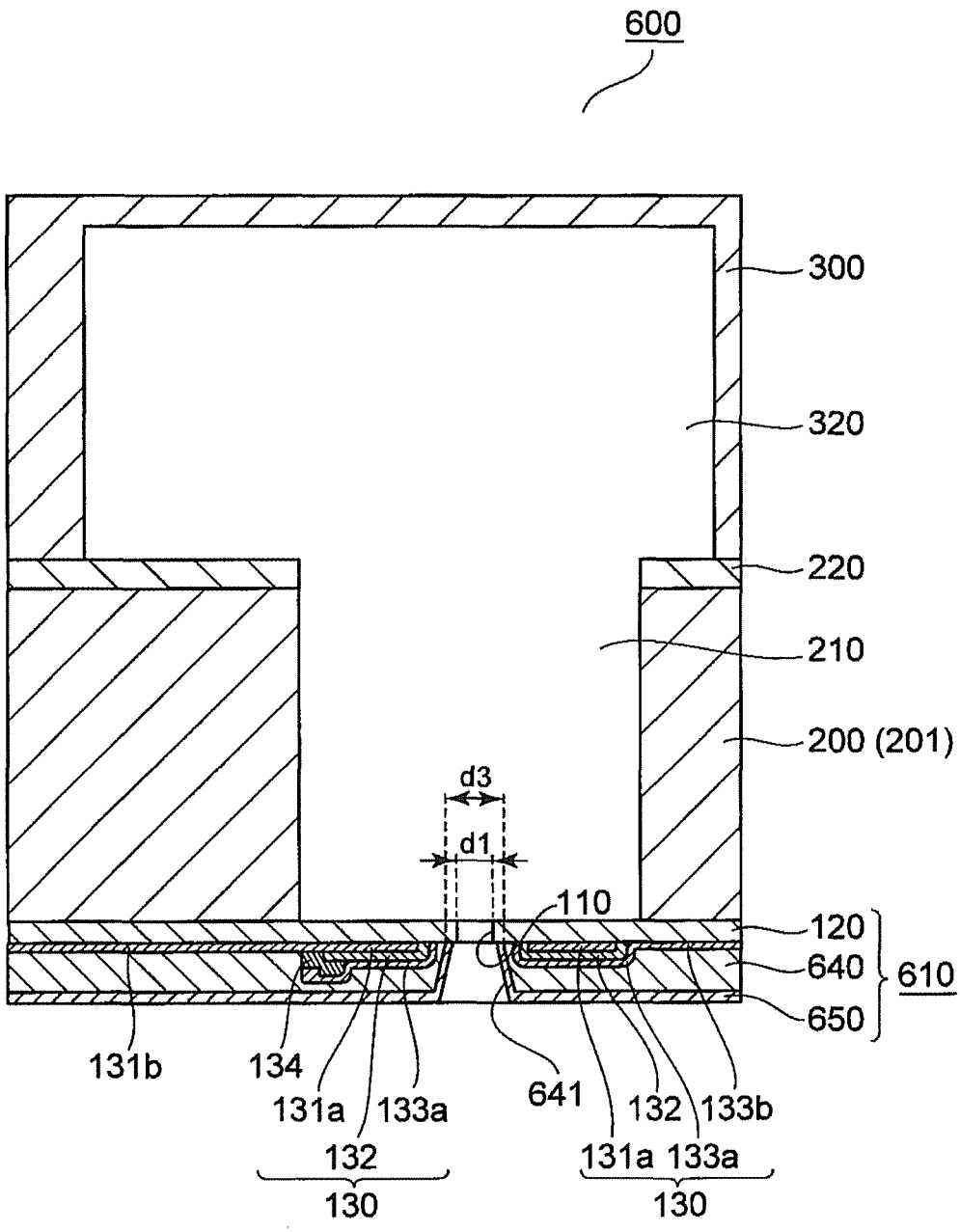
FIG. 6 is a schematic cross-sectional view which illustrates an ink jet head according to a fourth embodiment.

As illustrated in FIG. 6, a nozzle plate 610 of the ink jet head 600 includes a nozzle 110 with a diameter of d1, and a driving element 130 on a vibrating plate 120, and further includes a protective film 640 and an ink repellent film 650. A material of the protective film 640 is set to a negative type photosensitive polyimide. The protective film 640 includes an ink passage unit 641 of which an axis is the same to the nozzle 110, of which a diameter d3 on the vibrating plate 120 side is larger than that of the nozzle 110, and has a trapezoidal cross section. For example, the diameter of the nozzle 110 is set to 20 μm, and the diameter of the ink passage unit 641 on the vibrating plate 120 side is set to 30 μm. The cross section of the ink passage unit 641 which becomes wide to the ink repellent film 650 side is formed in a trapezoidal shape. The ink repellent film 650 covers the front surface of the ink passage unit 641 of the protective film 640, and communicates with the nozzle 110. The ink passage unit 641 communicates with the nozzle 110 through the ink repellent film 650.

When manufacturing the ink jet head 600, the negative type photosensitive polyimide film with the thickness of 3 μm, for example, is formed after forming a driving element 130 of the vibrating plate 120 including the nozzle 110. The protective film 640 including the ink passage unit 641 is formed by patterning the negative type photosensitive polyimide film. The protective film 640 exposes a terminal unit 131*c* of a lower electrode 131, and a terminal unit 133*c* of an upper electrode 133. The ink repellent film 650 is formed on the protective film 640 while discharging positive pressure air from the nozzle 110. The ink repellent film 650 covers the protective film 640 without adhering to the inner peripheral surface of the nozzle 110.

In general, when patterning the negative type photosensitive polyimide film, exposure light is radiated in the vertical direction with respect to an etching mask as much as possible. However, the exposure light spreads in a planar direction in the negative type photosensitive polyimide film after passing through the etching mask. When the exposure light spreads in the planar direction in the negative type photosensitive polyimide film, there is a concern that an etching face may be inclined when the film thickness of the negative type photosensitive polyimide film is large.

A shape of the cross section of the ink passage unit 641 which becomes wide toward the ink repellent film 650 is set to a trapezoidal shape, and the diameter d3 of the ink passage unit 641 on the vibrating plate 120 side is set to be larger than the diameter d1 of the nozzle 110. Even when the etching face of the ink passage unit 641 is inclined when being patterned, it is possible to prevent a landing position of ink droplets which are ejected from the nozzle 110 from being deviated by being influenced by the ink passage unit 641, by making an opening of the ink passage unit 641 wide.

According to the fourth embodiment, since the ink jet head 600 includes a warpage reducing film 220 similarly to the third embodiment, it is possible to reduce warpage of the ink jet head 600 in the longitudinal direction. Since the inkjet head 600 obtains a uniform ink ejecting angle over the entire length in the longitudinal direction, and obtains uniform printing precision, it is possible to provide a good printed image.

In addition, in the ink jet head 600, a shape of the cross section of the ink passage unit 641 which is formed in the protective film 640 is set to a trapezoidal shape which becomes wide toward the ink repellent film 650. The diameter of the ink passage unit 641 on the vibrating plate 120 side is set to be larger than the diameter of the nozzle 110. Even when the etching face of the ink passage unit 641 is inclined when being patterned, ink droplets which are ejected from the nozzle 110 are not influenced by the ink passage unit 641. The ink droplets which are ejected from the nozzle 110 maintain good precision in a landing position, and the ink jet head 600 realizes high printing precision when performing printing.

Fifth Embodiment

An ink jet head 700 in a fifth embodiment will be described with reference to FIG. 7. In the fifth embodiment, a structure of a driving element is different from that of the first embodiment. In the fifth embodiment, the same configurations as those which are described in the first embodiment will be given the same reference numerals, and detailed descriptions thereof will be omitted.

Figure 7:
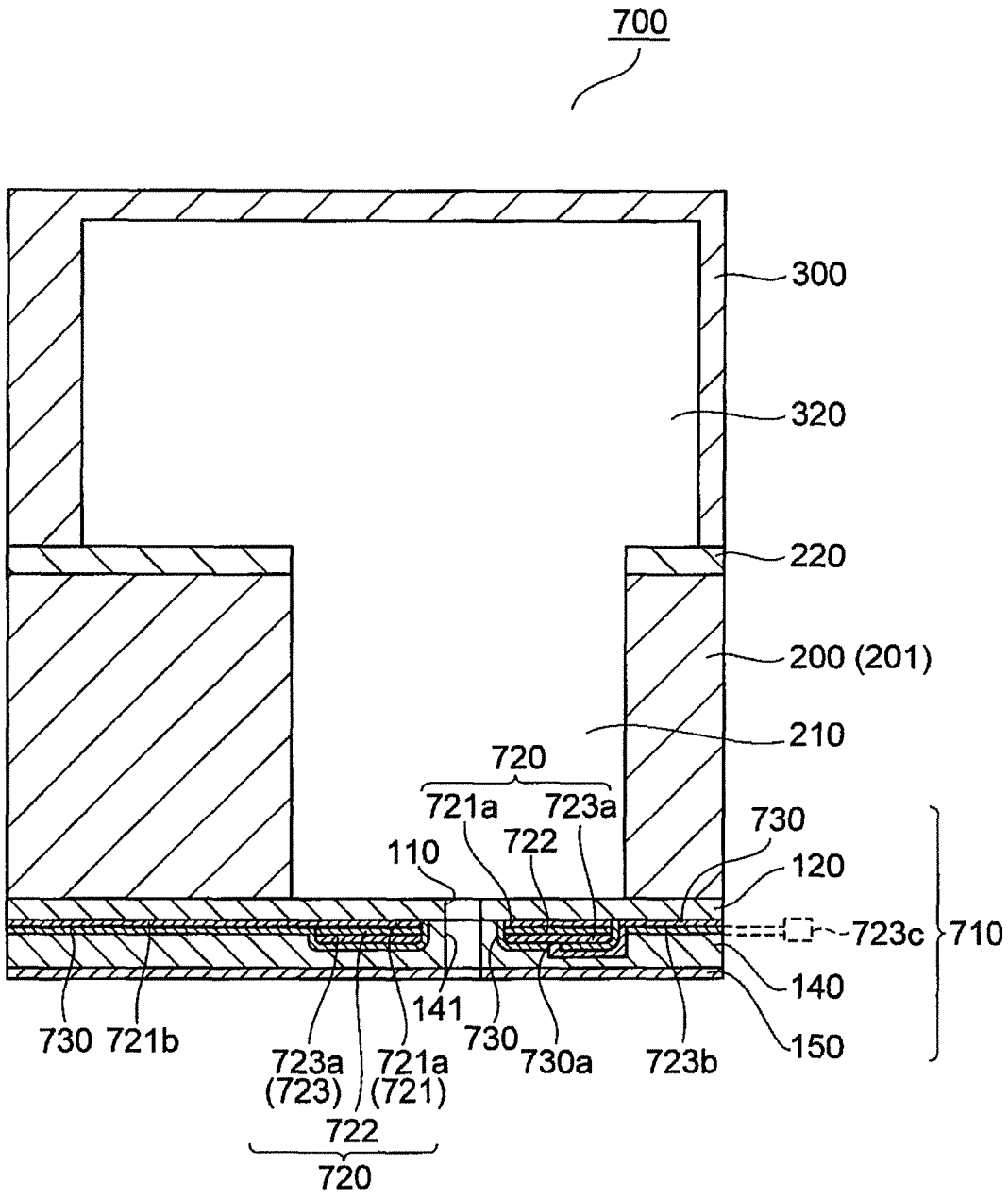
FIG. 7 is a schematic cross-sectional view which illustrates an ink jet head according to a fifth embodiment.

As illustrated in FIG. 7, a nozzle plate 710 of the ink jet head 700 includes a driving element 720 on a vibrating plate 120. The driving element 720 includes an electrode unit 721*a* of a lower electrode 721, a piezoelectric film 722, and an electrode unit 723*a* of an upper electrode 723. The electrode unit 721*a*, the piezoelectric film 722, and the electrode unit 723*a* have the same axes to the nozzle 110, and have circular patterns with the same size. The nozzle plate 710 includes an insulating film 730 which insulates the lower electrode 721 from the upper electrode 723.

The insulating film 730 covers peripheries of the electrode unit 721*a*, the piezoelectric film 722, and the electrode unit 723*a* in a region of the driving element 720. The insulating film 730 covers a wiring unit 721*b* of the lower electrode 721. The insulating film 730 covers the vibrating plate 120 in a region of the wiring unit 723*b* of the upper electrode 723. The insulating film 730 includes a contact unit 730*a* which electrically connects the electrode unit 723*a* of the upper electrode 723 and the wiring unit 723*b*.

An atomic arrangement of titanium (Ti), lead (Pb), zirconium (Zi), oxygen ($O_3$), or the like, in the PZT film used in the piezoelectric film 722 is regulated by an atomic arrangement of platinum (Pt) of the lower electrode 721 on a ground layer. In other words, the atomic arrangement of the PZT film depends on the atomic arrangement of the ground layer. When the atomic arrangement of the PZT film is regulated, polarization occurs along the film thickness direction of the PZT film.

For example, according to the first embodiment, the piezoelectric film 132 of PZT film with the diameter which is slightly larger than that of the electrode unit 131*a* is formed on the electrode unit 131*a* of the lower electrode 131. The atomic arrangement of the PZT film in an inner peripheral portion or in an outer peripheral portion of the piezoelectric film 132 related to an inner peripheral portion or an outer peripheral portion of the electrode unit 131*a* which is a step difference portion is influenced by the step difference portion of the electrode unit 131*a*. There is a possibility that the atomic arrangement of the PZT film of the piezoelectric film 132 in the film thickness direction may be different in a region of the inner peripheral portion or in a region of the outer peripheral portion, and in a region other than that. When the atomic arrangement of the piezoelectric film 132 is different in the region of the inner peripheral portion or in the region of the outer peripheral portion, and in the region other than that, there is a possibility that polarizability of the piezoelectric film 132 may decrease in the region of the inner peripheral portion or in the region of the outer peripheral portion.

The driving element 720 according to the fifth embodiment has a circular pattern in which diameters of the electrode unit 721*a* of the lower electrode 721 and the piezoelectric film 722 which are laminated are the same. The piezoelectric film 722 is not influenced by the step difference portion of the electrode unit 721*a* in the inner peripheral portion or the outer peripheral portion. The atomic arrangement of the piezoelectric film 722 in the film thickness direction is the same in the entire region of the circular pattern. In the piezoelectric film 722, there is no concern that the polarizability in the region of the inner peripheral portion or in the region of the outer peripheral portion may decrease, and high polarizability is obtained in the entire region in the thickness direction. In the driving element 720 which includes the piezoelectric film 722 with high polarizability, it is possible to reduce a driving voltage which is necessary for deformation of the vibrating plate 120.

When manufacturing the ink jet head 700, materials of the lower electrode 721, the piezoelectric film 722, and the upper electrode 723 are formed as films on the vibrating plate 120 which includes the nozzle 110. The electrode unit 723*a* of the upper electrode 723, and the piezoelectric film 722 are patterned using the same etching mask, reserving the material film of the lower electrode 721. A material of the insulating film 730 is formed as a film after patterning the lower electrode 721 using the etching mask of the lower electrode 721. After patterning the insulating film 730, the material of the upper electrode 723 is formed as a film, and the driving element 720 is formed by patterning the wiring unit 723*b* of the upper electrode 723 and the terminal unit 723*c*.

According to the fifth embodiment, since a warpage reducing film 220 is included similarly to the first embodiment, it is possible to reduce warpage of the ink jet head 700 in the longitudinal direction. Since the ink jet head 700 obtains a uniform ink ejecting angle over the entire length in the longitudinal direction, and obtains uniform printing precision, it is possible to provide a good printed image.

In addition, according to the fifth embodiment, the piezoelectric film 722 of the driving element 720 of the ink jet head 700 has a circular pattern with the same size as that of the electrode unit 721*a* of the lower electrode 721, and is laminated in the same axis as that of the lower electrode. The piezoelectric film 722 is not influenced by the step difference portion at the periphery of the electrode unit 721*a*, and polarizability in the region of the inner peripheral portion or in the region of the outer peripheral portion does not decrease. Since the piezoelectric film 722 obtains the same polarizability over the entire region in the thickness direction, it is possible to increase the polarizability of the piezoelectric film 722. By increasing the polarizability of the piezoelectric film 722, it is possible to save a driving voltage which is supplied to the driving element 720 so as to drive the vibrating plate 120.

In the above described embodiments, the driving unit is set to be circular, however, a shape of the driving unit is not limited. The shape of the driving unit may be a diamond shape, oval, or the like, for example. For example, when the diamond shaped driving units are arranged by being shifted alternately, since neighboring driving units can be closely arranged, it is possible to increase arrangement density of the driving unit. In addition, a shape of the pressure chamber is also not limited to a circular shape, and may be a diamond shape, an oval shape, a rectangle, or the like.

In addition, according to the embodiments, the nozzle is arranged in a center of the driving unit, however, when ink of the pressure chamber can be ejected, a position of the nozzle is not limited. For example, the nozzle may be formed outside the driving unit, not in the region of the driving unit. When the nozzle is arranged outside the driving unit, it is not necessary to perform patterning of the nozzle which penetrates the plurality of film materials of the driving unit, the ink passage unit which communicates with the nozzle, or the like. It is possible to form the nozzle only by patterning the vibrating plate of the nozzle plate and the protective film, and patterning of the nozzle becomes easy. When the nozzle is arranged outside the driving unit, it is possible to prevent deviating of the landing position of ink droplets which is caused by defective patterning of the nozzle.

According to at least one of the above described embodiments, the ink jet head includes the warpage reducing film. The warpage reducing film can reduce an occurrence of warpage in the ink jet head which is caused by a difference in a membrane stress between laminated films and the substrate, when the constituent members are created on the substrate according to a film forming process. The ink jet head with no warpage can obtain a uniform ink ejecting angle over the entire length in the longitudinal direction, and can provide a good printed image by obtaining uniform printing precision.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. These embodiments or modifications thereof would fall within the scope and spirit of the invention, and are included in the invention described in claims and their equivalents.

What is claimed is:

1. An ink jet head comprising:

a substrate including a first surface and a second surface opposite the first surface;

a pressure chamber which is formed in a thickness direction of the substrate to penetrate the substrate, and in which ink is filled;

a vibrating plate which is provided on the first surface, and includes a nozzle which communicates with the pressure chamber;

a driver unit which is provided on the vibrating plate, and includes a piezoelectric substance;

a warpage reducing layer which is made of a thermal oxidation film formed on the second surface to reduce warpage of the substrate; and an ink flow path which fluidly communicates with the pressure chamber, wherein materials of the warpage reducing layer and the vibrating plate are the same, and film thickness of the warpage reducing layer and the vibrating plate are the same.

2. The head according to claim 1, further comprising:

a protective layer which covers the driver unit and includes the nozzle which communicates with the pressure chamber.

3. An ink jet recording apparatus comprising:

the head according to claim 2; and a transport unit which transports a recording medium to a position at which the ink is ejected from the ink jet head.

4. An ink jet recording apparatus comprising:

the head according to claim 1; and a transport unit which transports a recording medium to a position at which the ink is ejected from the ink jet head.

5. An ink jet head comprising:

a silicon wafer having a first surface and a second surface opposite the first surface;

a first silicon oxide film formed on the first surface of the silicon wafer;

a second silicon oxide film formed on the second surface of the silicon wafer;

a pressure chamber which is formed in a thickness direction of the silicon wafer to penetrate the silicon wafer and the second silicon oxide film;

a nozzle which is formed in the first silicon oxide film to communicate with the pressure chamber and eject an ink therefrom;

a driving unit which is provided on the first silicon oxide film opposite the silicon wafer, and includes a piezoelectric substance; and an ink flow path which fluidity communicates with the pressure chamber, wherein the first and second silicon oxide films are the same thickness.

6. The head according to claim 5, further comprising a protective layer which covers the driving unit and includes the nozzle which communicates with the pressure chamber.

7. An ink jet recording apparatus comprising:

the head according to claim 5; and a transport unit which transports a recording medium to a position at which the ink is ejected from the ink jet head.

* * * * *